US008409309B2

(12) United States Patent
Meusel et al.

(10) Patent No.: US 8,409,309 B2
(45) Date of Patent: Apr. 2, 2013

(54) HOLLOW BODY COMPRISING AN INTEGRATED OIL SEPARATOR UNIT

(75) Inventors: Juergen Meusel, Dittmansdorf (DE); Ulf Mueller, Chemnitz (DE); Andreas Stapelmann, Oberhausen (DE); Daniel Paul, Burkardsdorf (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 0 days.

(21) Appl. No.: 13/255,804

(22) PCT Filed: Jan. 16, 2010

(86) PCT No.: PCT/EP2010/000229

§ 371 (c)(1),
(2), (4) Date: Sep. 27, 2011

(87) PCT Pub. No.: WO2010/102687

PCT Pub. Date: Sep. 16, 2010

(65) Prior Publication Data

US 2012/0031276 A1 Feb. 9, 2012

(30) Foreign Application Priority Data

Mar. 10, 2009 (DE) ..... 10 2009 012 400

(51) Int. Cl.
*B01D 46/00* (2006.01)

(52) U.S. Cl. ..... 55/357; 55/400; 55/413; 55/447; 55/456; 55/457; 55/459.1; 96/400

(58) Field of Classification Search ..... 55/400, 55/413, 447, 456, 457, 459.1; 96/400
See application file for complete search history.

(56) References Cited

U.S. PATENT DOCUMENTS

| | | | | |
|---|---|---|---|---|
| 4,329,968 | A * | 5/1982 | Ishikawa et al. | 123/573 |
| 4,651,704 | A * | 3/1987 | Sekiguchi | 123/572 |
| 7,717,101 | B2 * | 5/2010 | Beetz et al. | 123/572 |
| 2007/0294986 | A1 * | 12/2007 | Beetz et al. | 55/385.3 |

FOREIGN PATENT DOCUMENTS

| | | | |
|---|---|---|---|
| DE | 10 2004 008826 | A1 | 9/2005 |
| DE | 10 2005 034273 | A1 | 6/2006 |
| JP | 08 284634 | A | 10/1996 |
| WO | WO 2006119737 | A1 * | 11/2006 |

OTHER PUBLICATIONS

International Search Report for PCT/EP2010/000229 dated May 25, 2010.

Schneider, Falk, et al., "Integration of additional functions into the assembled camshaft.", 2008.

* cited by examiner

*Primary Examiner* — Jason M Greene
*Assistant Examiner* — Dung H Bui
(74) *Attorney, Agent, or Firm* — Crowell & Moring LLP

(57) ABSTRACT

A hollow body, in particular a camshaft, is provided. The hollow body includes an integrated oil separator unit, a swirl generator being located in a cavity of the hollow body and the hollow body having at least one supply opening in the camshaft case for introducing gas that is charged with oil into the cavity and at least one discharge opening for carrying away separated oil and gas that has been cleaned of oil. The hollow body has an oil separator ring inside the cavity, downstream of the swirl generator when viewed in the flow direction.

18 Claims, 8 Drawing Sheets

Figure 1:
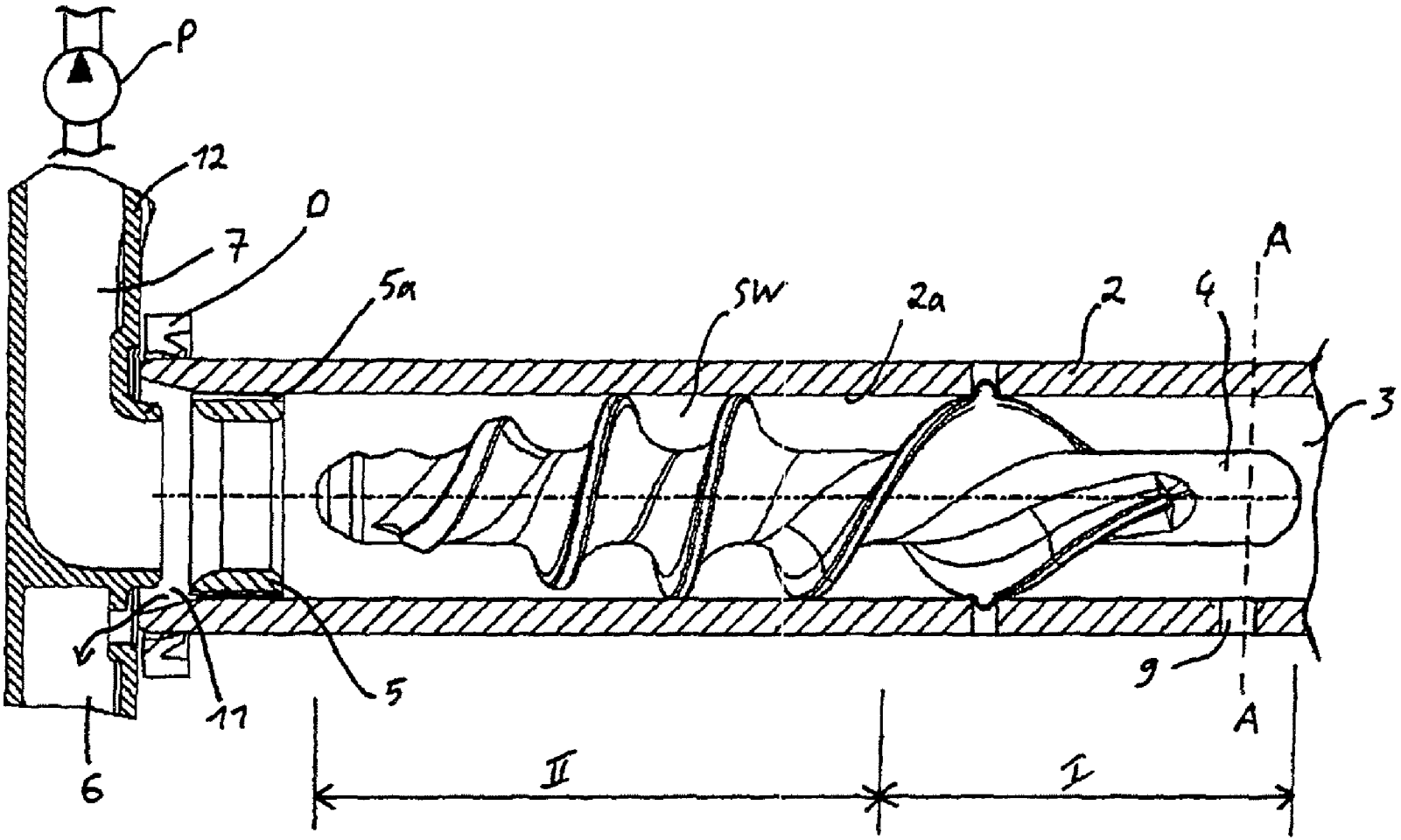

Fig. 5a
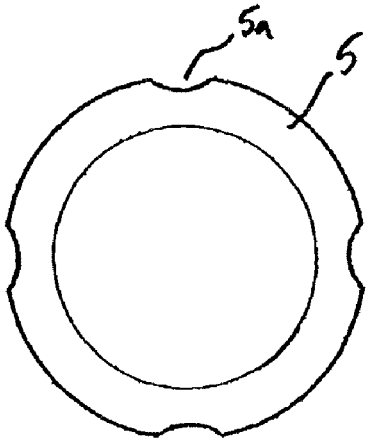
Fig. 5b
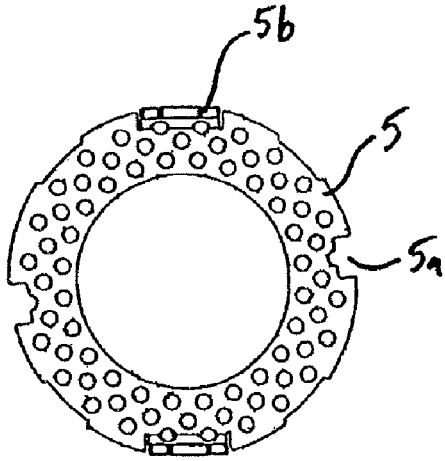
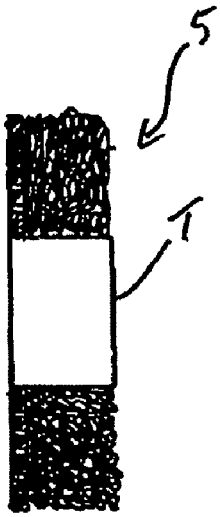
Fig. 5c
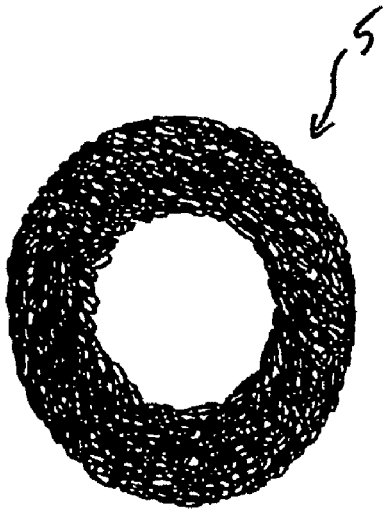
Fig. 5d

Fig. 6
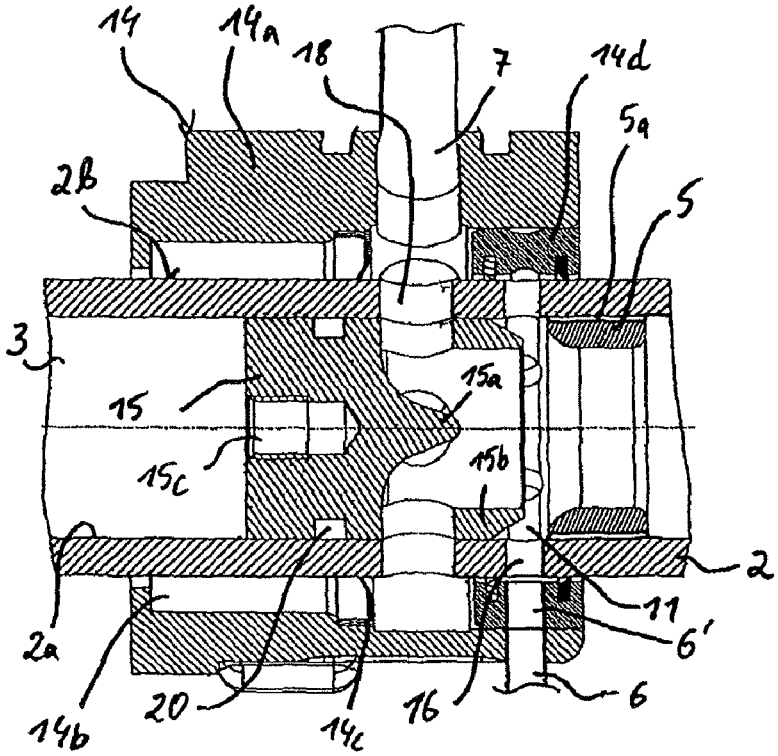
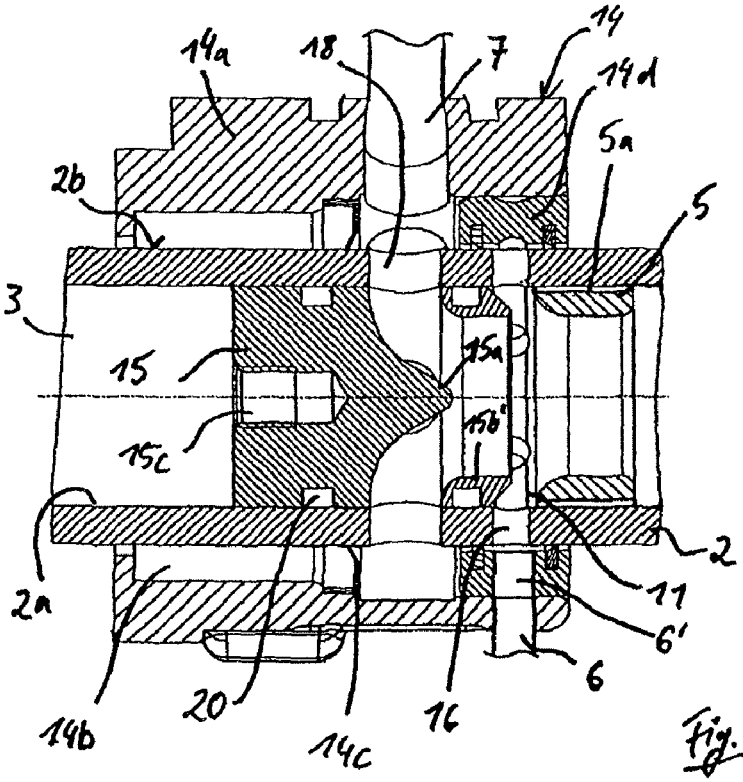
Fig. 7

HOLLOW BODY COMPRISING AN INTEGRATED OIL SEPARATOR UNIT

BACKGROUND AND SUMMARY OF THE INVENTION

The present invention relates to a body which is formed at least in regions in a hollow-cylindrical manner, is designated hereinafter as a hollow body and has an integrated oil separating device. Preferably, the hollow body is formed by a camshaft.

PCT publication WO 2006/119737 A1 discloses a hollow shaft having an integrated oil separating device, wherein in addition to a pre-separator, which is disposed on the outer periphery of the shaft, there is provided a swirl generator, which is integrated into the cavity of the shaft, as a final separator.

Furthermore, a camshaft having integrated oil separation is already disclosed in a VDI-report (VDI-Reports no. 2042, 2008, page 152, Chapter 4 and FIG. 6), wherein a helical swirl generator is disposed in the cavity of the camshaft.

Exemplary embodiments of the present invention provide a generic hollow body having an integrated oil separating device which, with production-technology expenditure being kept as low as possible, ensures optimised oil separation from so-called blow-by-gases. Hereinafter, the blow-by-gas will also be referred to as oil mist or oil-charged gas with no change in meaning.

In accordance with the invention, disposed downstream—as seen in the flow direction—of the swill generator which is integrated into a hollow body and forms in this case a first (inner) oil separating stage, is an oil separating ring (acting as a second (inner) oil separating stage) (disposed coaxially in the cavity of the hollow body).

The swirl generator is advantageously formed as a body extending in the axial direction of the hollow body and comprising or forming at least one screw channel on the periphery which means that at least one flow channel is formed by the screw channel between the body of the swirl generator and the inner wall of the hollow body in order to guide the oil-charged gas fed into the camshaft and to separate oil particles on the inner wall-side. The blow-by-gas, which is to have the oil removed therefrom, flows through at least one bore disposed tangentially to the inner wall of the hollow body. For the introduction of the blow-by-gas, several bores are advantageously provided, wherein preferably each of the bores is disposed in particular tangentially to the inner wall of hollow body and the bores are disposed so as to be axially offset with respect to each other. In terms of the invention, a bore extending tangentially to the inner wall of the hollow body is to be understood to mean one positioned in a manner different from a radial arrangement of a bore such that the bore merges without any transitions (continuously) into the progression of the inner wall of the hollow body, which progression is circular as seen in cross-section, i.e., that a bore casing line extending in parallel with the bore longitudinal axis is disposed tangentially to the inner wall of the hollow body, which inner wall is circular as seen in cross-section.

In a particularly preferred embodiment of the invention, the body of the swirl generator comprises, at least in regions, a second screw channel. Two flow paths extending in parallel are hereby formed, at least in regions. The design of the hollow body having two screw channels is advantageously provided in the starting region of the swirl generator and the supply openings are arranged such that the oil-charged air (blow-by-gas) flowing in—substantially without any fluidic resistance or with minimized fluidic resistance—is fed to the interior of the hollow body. Since the blow-by-gas is aspirated into the cavity of the hollow body substantially by a negative pressure produced in the interior of the hollow body, the attempt is made to substantially maintain this negative pressure by minimizing fluidic resistance. The required negative pressure can be produced, for example, by a pump coupled to the cavity of the camshaft. The second screw channel is advantageously formed such that it extends approximately over half of a complete volution of a total of 360°.

The or each screw channel can be formed such that the pitch of the respective screw channel varies. The pitches of the two screw channels are preferably the same size, wherein the pitch is predetermined as a whole by the first (longer) screw channel or is dependent upon the requirements placed thereon. The pitch advantageously varies such that the distances of the screw walls of a screw channel and thus the cross-section of the flow paths or flow channels formed by the screw walls get smaller. The blow-by-gas is hereby accelerated further during its flow path and the negative pressure existing in the cavity of the hollow body is substantially maintained.

In order to discharge the separated oil and/or the blow-by-gas which has oil cleaned therefrom, one or more discharge openings can be provided in the hollow body on the casing-side, wherein the gas which has oil cleaned therefrom and flows in the axial direction through the hollow body is deflected outwards towards the radial discharge opening(s) by a flow deflection element, which is disposed in the cavity of the hollow body downstream of the discharge openings. The separated oil that flows along the inner wall of the hollow body in the flow direction is diverted from the hollow body by one or more casing-side oil discharge openings disposed upstream of the casing-side discharge openings for the gas as seen in the flow direction.

In a particularly preferred embodiment of the hollow body, it comprises bearing sections at a plurality of locations, via which it co-operates with a corresponding bearing device in the assembled state. These bearing sections are advantageously formed as hardened, smooth surfaces which co-operate with a corresponding bearing body for rotatable mounting of the hollow body. The bearing can be formed as a slide bearing or as any roller bearing. The or each radial discharge opening for draining off the separated oil and/or for draining off the purified blow-by-gas are advantageously disposed in the region of the bearing section. For the continued guidance of the drained-off oil and/or purified blow-by-gas, the bearing device co-operating with the bearing point likewise comprises corresponding discharge openings or discharge channels. The discharge openings and the corresponding discharge channels can be disposed substantially in the same direction and disposed so as to extend in parallel with each other. In another embodiment, it is feasible to dispose the discharge openings for oil or gas so as to be axially offset in each case and opposite each other in the hollow body and in the bearing device.

In another preferred embodiment of the invention, a bypass channel is integrated into the swirl generator. The bypass channel is formed by an axial (through-going) bore, open on both sides, through the hollow body. The bypass bore can be released by an integrated bypass valve dependent upon the pressure. For the fluidic deflection of blow-by-gas, the hollow body comprises at least one further casing-side supply opening for the introduction of oil-charged gas into the cavity of the hollow body. This further supply opening is disposed upstream of the swirl generator on the side of the swirl generator remote from the at least one discharge opening.

BRIEF DESCRIPTION OF THE DRAWING FIGURES

Figure 3:
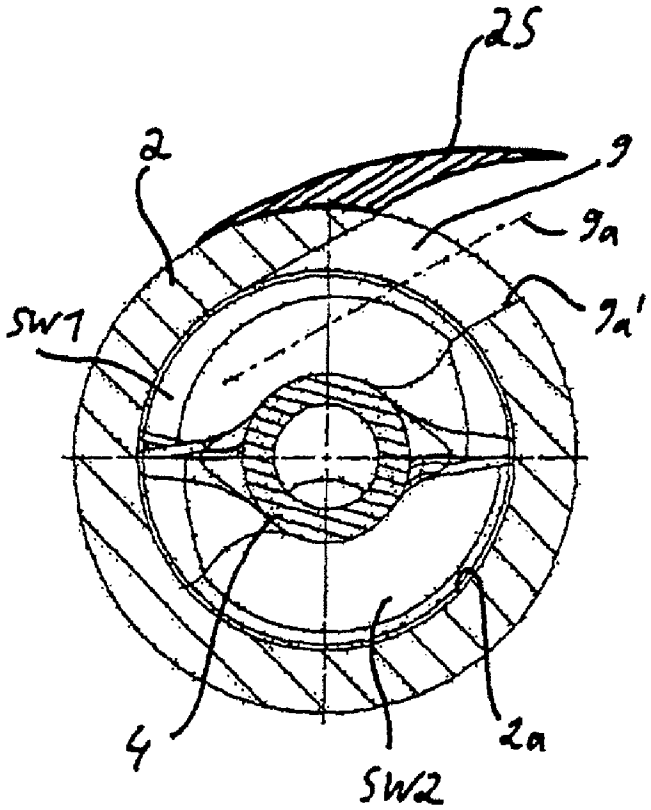
Figure 2:
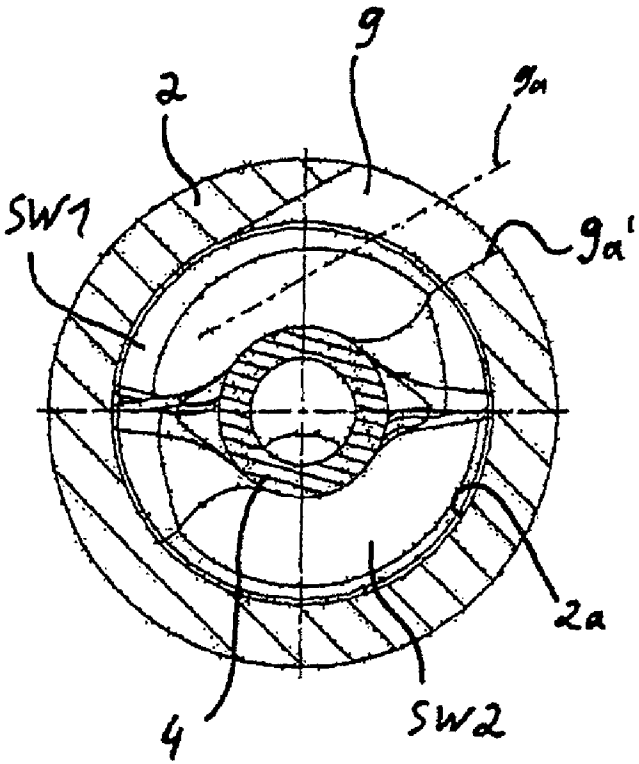
Figure 4:
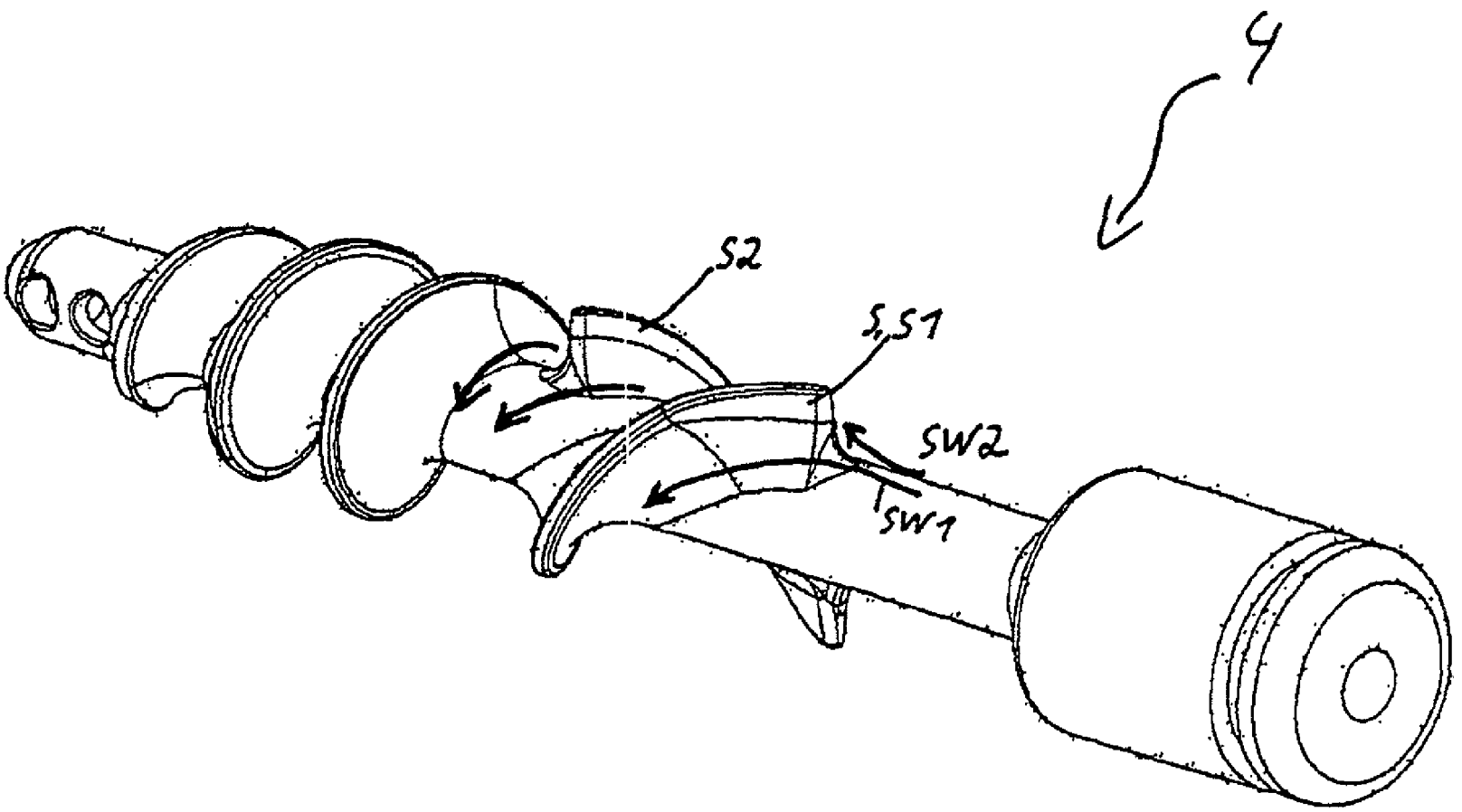
Figure 8:
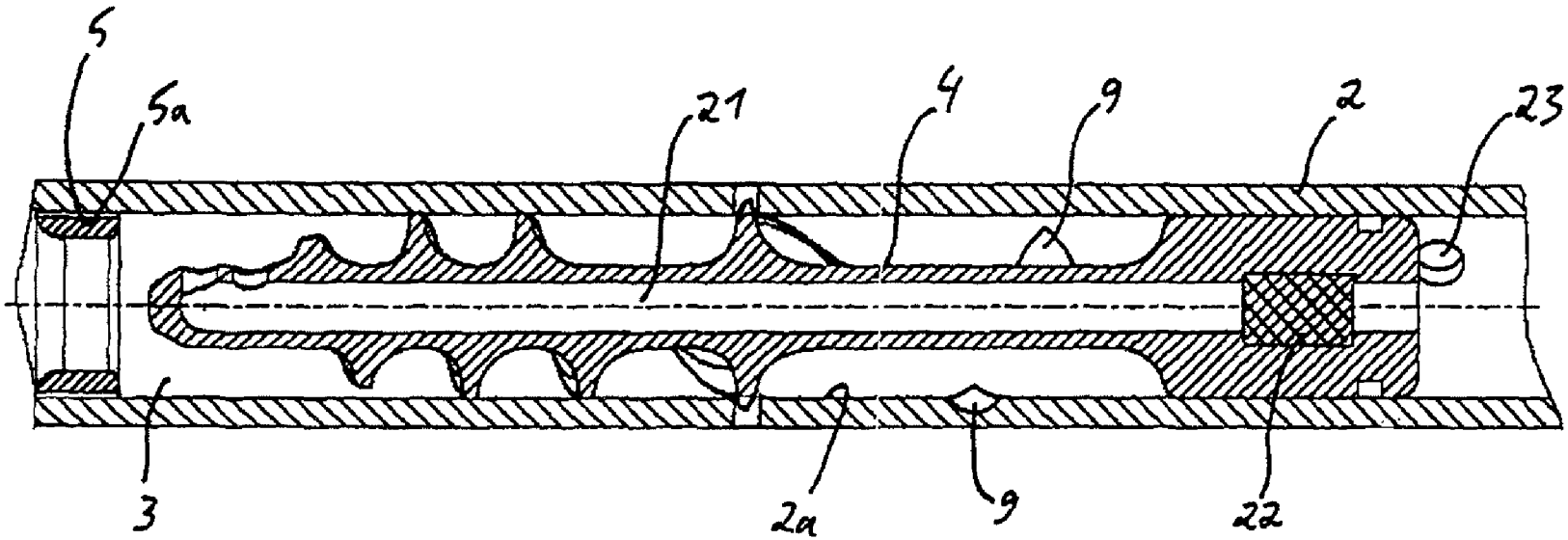
Figure 9:
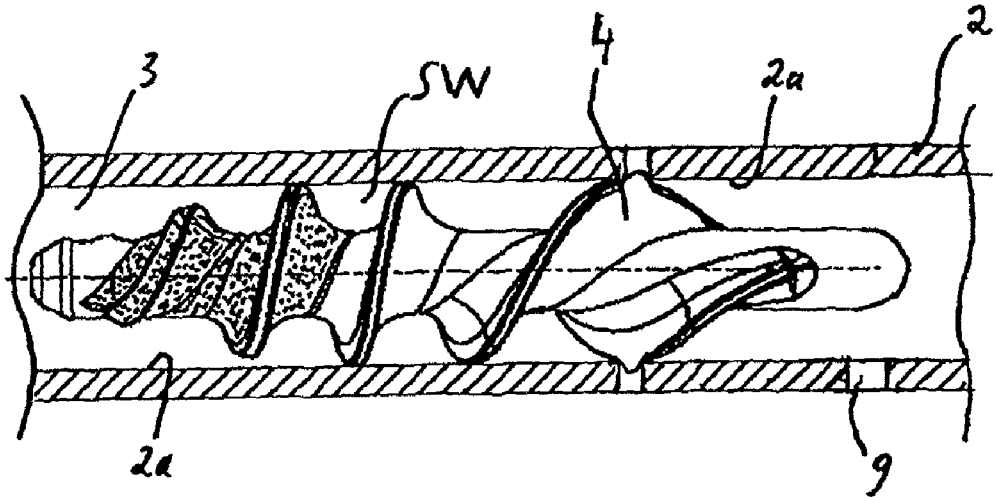
Figure 10:
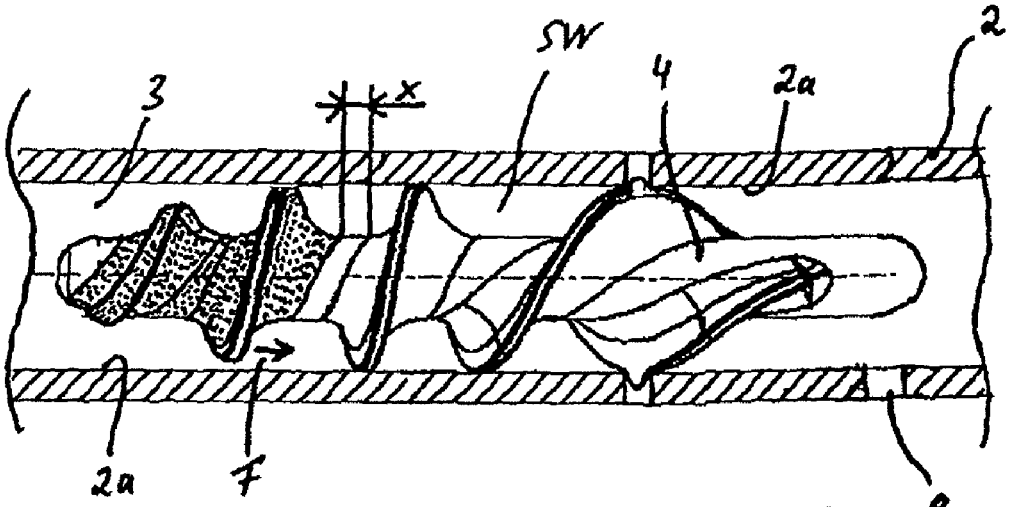

Further advantages and features as well as expedient developments of the invention are evident from the subordinate Claims and the following description of preferred embodiments of the invention with reference to the drawings, in which:

FIG. 1 shows a longitudinal sectional view of a hollow body in accordance with the invention having an integrated oil separating device in one possible embodiment, FIG. 2 shows a cross-sectional view through the hollow body of FIG. 1 along the sectional line A-A, FIG. 3 shows a cross-sectional view through the hollow body similar to FIG. 2 in another embodiment, FIG. 4 shows a schematic illustration of a swirl generator to be integrated into the hollow body in one possible embodiment, FIGS. 5*a*)-*g*) show an oil separating ring in different possible embodiments, FIG. 6 shows a longitudinal sectional view of a partial region of the hollow body in accordance with the invention in the region of the discharge channels for oil and gas in a first possible embodiment, FIG. 7 shows a longitudinal sectional view of a further possible embodiment of the hollow body in the partial region of its discharge channels for oil and gas, FIG. 8 shows a cross-sectional view through the hollow body having an integrated oil separating device with a bypass channel, and FIGS. 9, 10 show an illustration of sections of the hollow body having an integrated swirl body with a screw channel (section) which can be axially displaced.

DETAILED DESCRIPTION

FIG. 1 schematically illustrates the oil separating device in accordance with the invention or a hollow body 2 in accordance with the invention, which is also referred to hereinafter as a shaft body 2 or camshaft 2, having an integrated oil separating device. The oil separating device is formed by an axially hollow shaft body 2 having a cavity 3, a swirl generator 4 disposed in the cavity 3, an oil separating ring 5 and an oil discharge channel 6 and a gas discharge channel 7. The camshaft 2 comprises a supply opening 9 having a longitudinal axis 9*a*, wherein the longitudinal axis 9*a* is different from any radial axis through the centre point of the shaft body 2. The longitudinal axis 9*a* of the supply opening 9 advantageously extends such that a bore wall section 9*a*' (or its extended axis, FIG. 2), extending in parallel herewith, of the supply opening 9 extends tangentially to the inner wall 2*a* (hereinafter also referred to as casing surface 2*a*), which is circular as seen in cross-section, of the cavity 3 into which it issues. In terms of the invention, a bore extending tangentially to the inner wall of the shaft body 2 is understood to mean one which is positioned in a manner different from a radial arrangement of a bore such that the bore merges without any transitions (continuously) into the progression of the inner wall of the shaft body 2, which progression is circular as seen in cross-section, i.e., that a bore wall section 9*a*' extending in parallel with the bore longitudinal axis 9*a* is disposed or extends tangentially to the inner wall 2*a* of the shaft body 2, which inner wall is circular as seen in cross-section. The blow-by-gas, which is to be have the oil cleaned therefrom, flows through the tangential supply opening 9 into the cavity 3 and already acquires a predetermined swirl upon entering through the supply opening(s) 9. The tangential progression of the supply openings 9 favors the flow of the blow-by-gas at and through the supply openings 9 into the cavity 3 and additionally feeds the blow-by-gas directly to the casing surface of the cavity 3. Owing to the centrifugal forces at work, relatively heavy oil particles in the blow-by-gas are urged against the inner wall 2*a* (casing surface) of the cavity 3 where they are separated as oil film.

In a preferred manner, several supply openings 9 are incorporated in the camshaft 2, wherein these are then preferably distributed over the periphery of the camshaft 2 and are spaced apart from each other axially in relation to the centre axis of the camshaft 2. The swirl of the blow-by-gas flowing into the cavity 3 and thus also the efficiency of the oil separating device can be increased once again.

When configuring the oil separating device, blades 2S disposed on the outer periphery of the camshaft 2 in the region of the supply openings 9 can assist the flow of the blow-by-gas into the cavity 3 of the shaft body 2 (FIG. 3). The blades 2S can be attached to the camshaft 2 by a firmly-bonded, non-positive-locking, or positive-locking process.

The swirl generator 4 (acting as a first separation stage) disposed downstream of the supply openings 9 is formed in a substantially helical manner, wherein it comprises at least one screw channel S on the periphery. Formed by the screw channel S between the body of the swirl generator 4 and the inner wall 2*a* of the shaft body 2 is a flow channel SW for guiding the fed-in, oil-charged gas (oil mist, blow-by-gas). The at least one supply opening 9 is disposed relative to the starting region of the at least one screw channel S of the swirl generator 4 such that the pressure loss by way of flow deviation is minimized. The swirl generator 4 is functionally divided over its entire length into two partial sections I and II. The partial section I is disposed upstream of the partial section II as seen in the flow direction. Formed in the partial sections I and II by means of the casing surface 2*a* of the cavity 3 is a coil-shaped flow path or flow channel section, wherein the pitch of the screw channel S (or of the screw channels S1, S2) can vary over the length of the partial sections I and II, in particular decreasing in the flow direction. Furthermore, the pitch can also be formed differently within the partial sections I or II. The pitch in the partial sections I and II can directly influence the flow cross-section of the flow channel SW; SW1, SW2 of the swirl generator 4 and thus the flow rate in the flow channel SW; SW1, SW2 can be influenced. Therefore, for example, a reduction of the flow cross-section A causes an increase in the flow rate in the corresponding flow channel section.

As shown in particular in FIG. 4, the swirl generator 4 can comprise a further screw channel S2 at least in regions. The second screw channel S2 extends in the illustrated exemplified embodiment approximately over half of a complete volution (extending over 360°. It is formed so as to extend in the same manner (and direction) as the first screw channel S1 and, in relation to its axial starting point, is disposed to be offset (forwards) in the flow direction—in particular offset by approximately the length of a half screw channel. Two flow paths SW1, SW2 extending in parallel can be formed hereby at least in regions in particular at the beginning of the screw channel with a fluidic resistance which is as small as possible.

The swirl generator 4 or its screw channel S or screw channels S1, S2 is/are disposed in the shaft body 2 in relation to the supply openings 9 such that the or each supply opening 9 still issues into the cavity 3 of the shaft body 2 upstream of the start of the first screw channel. The swirl generator 4 is advantageously fixedly attached in the cavity 3 of the shaft body 2 so that it also effects the rotational movement of the driven camshaft 2. The swirl generator 4 can be disposed in the shaft body 2 via firmly-bonded, positive-locking or non-positive-locking connections. In the illustrated exemplified embodiment, the swirl generator 4 comprises protrusions by means of which it is held in the casing-side openings of the shaft body 2. The swirl generator 4 consists of a material that effectively withstands the heat occurring in the region of the camshaft 2 as well as the contact with oil.

An additional swirl is forced upon the blow-by-gas, entering the cavity 3 via the supply opening 9, by the swirl generator 4, whereby relatively large centrifugal forces act upon the oil floating in the blow-by-gas. The oil particles (droplets and/or solid particles) which cannot follow the flow are thus separated on the casing surface 2*a* of the cavity 3 as oil film. The centrifugal force produced by the swirl generator 4 is so large that even oil particles having a low mass are separated. The oil film is driven further downstream by the flow.

The swirl generator 4 imposes a swirl upon the blow-by-gas, whereby the amount and mass of the oil particles floating in the oil mist increase as the radial distance from the axis of the camshaft 2 increases. An oil separating ring 5 disposed downstream of the swirl generator 4 (and forming a second oil separating stage) is located directly in the gas flow enriched with oil particles in the casing-side cavity region. The oil separating ring 5 is partly supported with its periphery on the casing surface 2*a* of the cavity 3. Axially extending recesses 5*a* are advantageously disposed so as to be distributed over the periphery of the oil separating ring 5, whereby the oil separating ring 5 does not lie with its entire periphery on the casing surface 2*a* of the cavity 3 and the separated oil or the oil film flowing at the casing surface 2*a* can flow in the direction of the oil discharge channel 6.

In a design in accordance with FIGS. 5*a*)-5*g*), the oil separating ring 5 is illustrated in different preferred designs. In each design, the oil separating ring 5 represents a considerable flow impediment for the flow in the region of the casing surface in the form of an impact element. The oil particles floating in the blow-by-gas cannot follow the quick change in direction at the oil separating ring 5, impact against the end surface of the oil separating ring 5 and are thus separated from the oil mist. Like the swirl generator 4, the oil ring 5 is also fixed in the desired position in the cavity 3 of the shaft body 2 by means of firmly-bonded, positive-locking or non-positive-locking processes known in the Prior Art.

In accordance with FIG. 5*a*, the oil separating ring 5 is designed in a simple design as a solid circular impact element (circular ring-shaped impact plate).

In FIG. 5*b*), the oil separating ring of FIG. 5*a*) is provided with a plurality of holes or rows of holes. In this design, an arrangement of several identical circular ring discs, which are disposed one behind the other in a rotationally offset manner and are held together in a composite structure via connector elements 5*b*, can form a system of mutually connected cavities so that a labyrinth of cavities penetrating the oil separating ring 5 are produced. The end surface of the oil separating ring 5 further represents an impact element, whereas the labyrinth is a combination of impact and deviation elements. Even relatively light oil particles are separated from the oil mist by means of these impact and deviation elements which means that the oil mist can now be considered as a purified gas downstream of the oil separating ring 5. Materials for the aforementioned designs of the oil separating ring 5 include, for example, porous synthetic materials or sintered materials. The oil separating ring 5 preferably also includes a synthetic material or metal meshwork (FIG. 5*c*)) which forms a plurality of cavities and labyrinths, wherein the oil separating ring 5 then preferably includes a hollow-cylindrical support ring T (FIG. 5*d*)) which supports the meshwork and which is additionally used to fix the meshwork in the cavity 3.

There is no example where the oil separating ring 5 lies with its entire periphery on the casing surface 8. Rather, the oil separating ring 5 comprises corresponding peripheral recesses 5*a* which means that the separated oil can flow as oil film along the casing surface 8 of the cavity 3 and through the recesses in the peripheral casing surface of the oil separating ring 5.

Figure 5E:
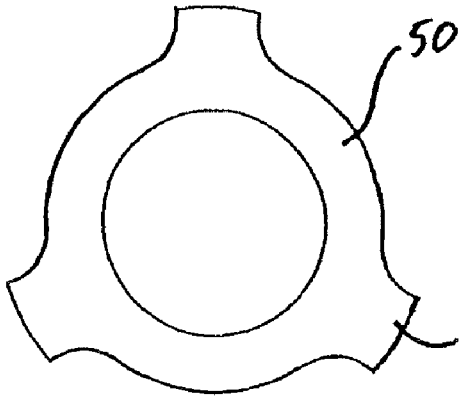
Figure 5G:
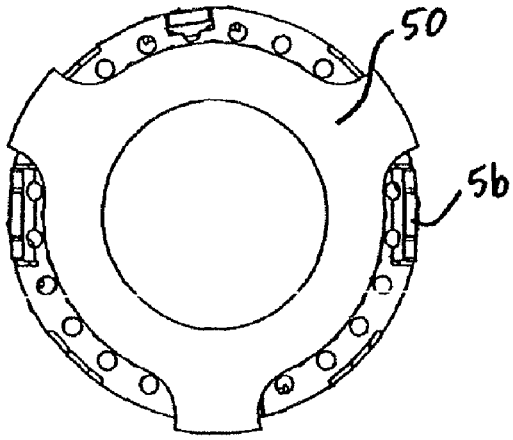
Figure 5F:
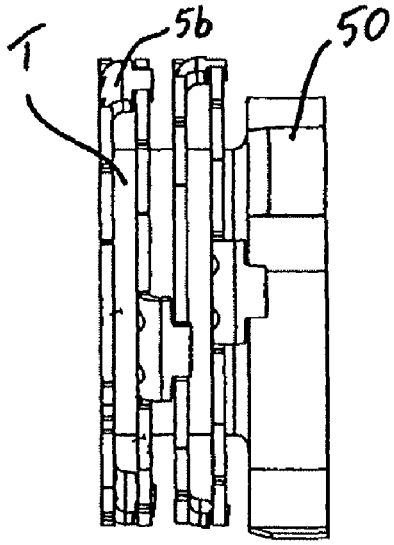

In a further embodiment of the oil separating ring 5 illustrated in FIGS. 5*e*) and 5*f*), a closed ring 50 (closure ring) having peripheral web regions 50*a* (support webs for the radial support in the cavity 3) pointing radially outwards are disposed downstream, as seen in the flow direction, of the sintered material, synthetic material or metal meshwork and/or the perforated sheet metal rings. The support ring T, which supports/holds the sintered material, meshwork and/or the perforated sheet metal rings, prevents the oil that has already been separated in the oil separating ring from being entrained in the direction of the center of the hollow body. The closed ring 50 represents a further impact element for the flow and only provides the gas flow flowing through the oil separating ring 5 in its labyrinth-like separating regions with the option of moving radially outwards in the direction of the inner wall 2*a* of the hollow body 2.

In any case, the oil separating ring 5 has the oil mist flowing against or through it which means that the oil particles are separated at that location and flow to the oil film already located at the casing surface of the cavity 3 (owing to the first oil separating stage "swirl generator"). The radial oil flow in the oil separating ring 5 is caused by the rotation of the camshaft 2. If the shaft body 2 is not formed as a rotating or rotatably mounted body, discharging of the separated oil can be achieved by an inclined mounted position of the shaft body (aim: discharge through weight and inclination) or by other suitable measures such as specific guiding of the purified gas flow (aim: "entrainment" of the separated oil).

Since the additional oil separator connected downstream of the swirl generator 4 is formed as a ring, a minimum flow cross-section (inner cross-section of the ring) is always provided for the gas flow. Therefore, the oil separating device is effectively and reliably protected against a loss of function caused by freezing or clogging.

Located downstream of the oil separating ring 5, e.g., on the end of the shaft body 2, is the oil discharge channel 6 and the gas discharge channel 7 (FIG. 1). The oil discharge channel 6 and the gas discharge channel 7 adjoin the camshaft 2 e.g., on the end side. Since the purified gas flows exclusively in the proximity of the axis of the camshaft 2, the gas discharge channel 7 or its discharge opening is also located in the proximity of the axis of the camshaft 2, which means that the gas discharge channel 7 receives and drains off only the purified gas. An immersion tube 12 which is T-shaped as seen in cross-section protrudes with its central limb into the camshaft, which is open on the end-side, and in the region of the camshaft outlet in proximity to the axis forms centrally a central gas discharge channel 7, and with the wall of the hollow camshaft forms on the edge-side an oil discharge channel 6. The connection between the immersion tube 12 and the camshaft is sealed via a sealing ring D located on the camshaft, which means that unpurified gas is not aspirated through the gas discharge channel. Within the camshaft 2, the wall of the central immersion tube 12 protruding into the camshaft is aligned with the inner diameter of the oil separating ring 5 (or its circular ring-shaped inner wall) whilst maintaining a defined axial distance, which means that a flow-calmed region 11 (in which the separated oil or the oil film can drain off in a manner virtually uninfluenced by the purified gas flowing past) is formed between the start of the oil discharge channel 6 and the oil separating ring 5. Draining off of the separated oil or oil film is assisted in one development of the oil separating device by an inner phase at the end of the camshaft 2 and by the rotation of the camshaft 2. The phase angle is to be selected such that, in consideration of the mounted position of the engine, the oil can automatically flow off after separation even when the engine is at a standstill and the camshaft 2 is thus stationary.

FIGS. 6 and 7 illustrate the oil discharge channel 6 and the gas discharge channel 7 in another design of the oil separating device. Both the oil discharge channel 6 and the gas discharge channel 7 are integrated into a bearing device 14 for mounting the camshaft 2. The components situated upstream of the oil separating ring 5 and the oil separating ring 5 itself are formed in a manner corresponding to the previously described components and a description thereof will therefore not be repeated.

FIG. 6 illustrates a partial longitudinal sectional view of a shaft body 2 that is formed as a hollow shaft, is rotatably mounted in a bearing device 14 and has an integrated oil separating device.

The bearing device 14 includes a bearing body 14*a*, which can be designed either in the form of a bearing block (formed e.g., by a cylinder head part) or as a separate component that can be attached to the cylinder head. For the rotatable mounting of the shaft body 2, the bearing device 14 can be designed in the form of the bearing body 14*a*, which is formed on its hollow-cylindrical inner surface so as to form a sliding bearing with a hardened region (bearing section 2*a*) of the shaft body 2. In another embodiment, the bearing device 14 can comprise a plurality of roller bodies 14*b* over its hollow-cylindrical inner surface, wherein the shaft body 2, which is surface-hardened at least in regions, is rotatably mounted via these roller bodies. In the latter case, also illustrated in FIGS. 6 and 7, the bearing device comprises a sealing ring 14*c* by means of which the adjacent gas discharge channel 7 is sealed with respect to the region with roller bodies 14*b*. Unpurified gas is hereby prevented from being aspirated into the gas discharge channel 7 and supplied to the internal combustion engine.

The shaft body 2 comprises at least one substantially radial discharge opening 16 for diverting the oil separated from the so-called blow-by-gas. In accordance with the illustrated embodiment, radial discharge openings 16, 18 for oil and gas are provided, wherein the shaft body 2 is supported by the bearing device 14 in the region of the discharge openings 16, 18. In order to drain off the purified gas and the separated oil, the bearing device 14 comprises, in each case, a discharge channel 6, 7 corresponding to the respective discharge opening 16, 18, for oil and gas respectively. In the region of the oil discharge openings 16, a radial sealing ring 14*d* is disposed in the bearing device 14 or in its bearing body 14*a* and comprises at least one oil channel 6' corresponding to the oil discharge opening 16 and to the oil drain-off channel 6. On its inner surface, the radial sealing ring 14*d* comprises a peripheral groove N into which the oil separated at the inner wall of the hollow body 2 and exiting through the peripherally distributed oil discharge openings 16 can be received and can be drained off via the oil channel 6' issuing into the groove N. The radial sealing ring 14*d*, which is held in the bearing device 14 in a peripheral, non-positive-locking manner and which is sealed with respect to the shaft body 2, rotating in the radial sealing ring 14*d*, via its sealing lips directed inwardly onto the shaft body surface, ensures reliable draining off of the separated oil and reliably prevents aspiration into the adjacent gas discharge channel 7.

In the illustrated embodiment, the shaft body 2 is kept rotatably mounted in the bearing device 14 via the rolling bodies 14*b*. The bearing section(s) 2*b* of the shaft body 2 co-operating with the roller bodies 14*b* (roller bearings) or with regions of the bearing body 14*a* (sliding bearing) can be designed as hardened and/or surface-treated shaft body section(s). If the bearing device 14 is not designed as a sliding bearing but rather as a roller bearing, roller body-free regions are provided for the arrangement of the discharge openings for oil or for oil and gas in the bearing device 14 or in the bearing body 14*a*. In the region of the shaft body 2, in which this co-operates with the bearing device 14 or is surrounded thereby, at least one radial discharge opening (or bore) 16;18 for diverting oil or gas is provided. Several bores disposed so as to be annularly distributed over the periphery of the shaft body 2 are in each case advantageously provided as discharge openings for gas or oil such that a bore ring consisting of a plurality of bores disposed so as to be annularly distributed over the periphery is formed for diverting the purified blow-by-gas and a bore ring is formed for diverting the oil separated from the blow-by gas. The or each casing-side discharge opening 16; 18 co-operates with a drain-off channel 6, 7 formed in the bearing device 14 or in the bearing body 14*a* and corresponding with the respective discharge opening 16, 18. The drain-off channel 6, 7 corresponding with the respective discharge opening(s) 16, 18 is designed within the bearing device 14 as an annular channel having at least one corresponding radial drain-off section for diverting the oil or gas to be diverted from the shaft body 2.

In order to be able to separately discharge the blow-by-gas—which is already substantially separated into its components gas or oil in the region of the discharge openings 16, 18—with its separate components, a flow deflection element 15 is disposed within the cavity 3 of the shaft body 2, the axially flowing gas flow being deflected by the flow deflection element into the at least one radial gas discharge opening 18. The flow deflection element 15 is provided on the periphery with a sealing element D in order to be able to drain off, if possible, all of the gas components of the purified blow-by-gas via the radial discharge openings 18. For this purpose, the flow deflection element 15 is formed in a substantially plug-like or cork-like manner and on its end side, facing the inflowing gas flow, comprises a cone-shaped extension 15*a* that is substantially centrally aligned. On the opposite end side, the flow deflection element 15 comprises a threaded bore 15*c*. This is used, in particular, for the relatively simple disassembly of the illustrated device. In order to be able to separately drain off the oil that has been separated at the inner wall 2*a* of the shaft body 2 by the integrated oil separating device, an oil guiding element 15*b*; 15*b*' is disposed between the oil discharge opening 16 and the at least one gas discharge opening 18 disposed downstream of the at least one oil discharge opening 16 as seen in the flow direction S. The oil guiding element 15*b* can be designed, as illustrated in FIG. 6, as one piece with the flow deflection element 15. In another embodiment of the invention, as illustrated in FIG. 7, the oil guiding element 15*b*' can be formed as a separate component in the form of an individual separating ring disposed between the gas discharge openings 18 and the oil discharge openings 16.

In accordance with a development of the oil separating device illustrated in FIG. 8, a bypass channel 21 extends axially in the swirl generator 4 and can be released by means of a bypass valve 22 in order to provide the blow-by-gas with an additional flow cross-section and thus ensure corresponding pressure regulation within the hollow body 2. The bypass channel 21 issues (as seen in the flow direction) in the end region of the swirl generator 4 into the cavity 3 preferably at an angle between 0° and 110° (in particular circa) 90° to the longitudinal axis of the swirl generator 4. The exit angle at which the bypass channel 21 issues into the cavity 3 of the shaft body 2 is preferably sized such that the blow-by-gas exiting the bypass channel 21 impinges upon the oil separating ring 5 located downstream as seen in the flow direction (by flowing against it, around it or through it) which means that at the ring oil separation is as efficient as possible. In a preferred design, the bypass channel 21 is designed in its exit region such that the central axis of its exit opening (or its exit channel section) extends at an angle of circa 90 angular degrees to the longitudinal axis of the swirl generator 4. The bypass valve 22 is connected to the outer region by means of additional supply openings 23 in the hollow body 2 and is influenced by the pressure of the blow-by-gas. The swirl generator 4 is formed such that it divides the cavity 3 of the shaft body 2 into two pressure regions which are separated in terms of pressure-technology and can be connected via the bypass valve 22. The additional supply openings 23 of the at least one first supply opening 9 are separated from each other in terms of flow technology by a separating body region of the swirl generator 4 (in which for example the bypass valve 22 is disposed). If a pump P—connected via the gas discharge channel 7 and generating the negative pressure in the cavity 3 of the shaft body 2—generates an excessive pressure or the pressure of the blow-by-gas in the outer region of the camshaft 2 is too great, the bypass valve 22 opens and releases the bypass channel 21 for the blow-by-gas. In this manner, the pressure loss via the swirl generator 4 can be kept virtually constant dependent upon the volume flow and the swirl generator 4 can be operated at a predetermined degree of efficiency.

In accordance with a development of the invention illustrated in FIGS. 9 and 10, at least one screw channel S; S1, S2 is formed to be mounted at least in regions in an axially displaceable manner on or at the basic body of the swirl generator 4. In particular, at least one screw channel S1, S2 (or a wall of a screw channel) is displaceable at least in regions on or at the basic body of the swirl generator 4 so that the cross-section of the coil-shaped flow path/flow channel SW can be actively changed/adjusted. Active adjustment of this kind can be effected, for example, by the gas flow of the blow-by-gas itself. For this purpose, the wall (or the corresponding screw channel (section)) is mounted on the basic body of the swirl generator 4 so as to be displaceable longitudinally along or on same. The displaceable screw channel (section) is kept in a predetermined position via a predetermined force (e.g., by a (return) spring) until a flow force greater than the spring force is produced by the through-flowing blow-by-gas and the screw channel (section) is displaced axially forwards in the flow direction in a manner dependent upon the flow pressure. Alternatively or in addition, the axial adjustment can also be effected manually or in an automated manner in dependence upon predetermined control parameters. The displaceably mounted screw channel (section) S' is illustrated shaded in a dot pattern, wherein in FIG. 10 an operating position of the displaceable screw channel (section) S' different from FIG. 9 is illustrated, in which the screw channel (section) has been displaced by a distance x as seen in the flow direction.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

Shaft body 2
Inner wall (hollow body) 2*a*
Bearing section 2*b*
Blade 2S
Cavity (shaft body) 3
Swirl generator 4
Oil separating ring 5
Closure ring 50
Support web 50*a*
Support ring T
Recess 5*a*
Connector element 5*b*
Discharge channel (oil) 6
Oil channel
(radial sealing ring) 6'
Discharge channel (gas) 7
Supply opening 9
Bore longitudinal axis 9*a*
Bore wall section 9*a'*
Flow-calmed region 11
Immersion tube 12
Bearing device 14
Bearing body 14*a*
Roller body 14*b*
Sealing ring 14*c*
Radial sealing ring 14*d*
Flow deflection element 15
Cone-shaped extension 15*a*
Oil guiding element 15*b*, 15*b'*
Threaded bore 15*c*
Discharge opening (oil) 16
Discharge opening (gas) 18
Sealing/fixing element 20
Bypass channel 21
Bypass valve 22
Further supply opening 23
Screw channel S; S1; S2
Flow channel SW; SW1, SW2
Flow path partial section I; II
Pump P
Groove (radial sealing ring) N

The invention claimed is:

1. A hollow body formed at least in regions in a hollow-cylindrical manner by a camshaft, having an integrated oil separating device, the hollow body comprising:

a swirl generator disposed in a cavity of the hollow body;

at least one casing-side supply opening configured for introducing gas, which is charged with oil, into the cavity, at least one discharge opening arranged for diverting separated oil and diverting gas, from which oil has been removed; and an oil separating ring is disposed within the cavity and downstream of the swirl generator as seen in a flow direction.

2. The hollow body as claimed in claim 1, wherein the oil separating ring lies with its outer casing surface on an inner wall of the hollow body and comprises at least one axially extending recess in its outer casing surface.

3. The hollow body as claimed in claim 1, wherein the hollow body comprises:

at least one first discharge opening configured for diverting separated oil from the cavity and at least one second discharge opening configured for diverting purified gas, from which oil has been removed, from the cavity, wherein the first discharge opening is formed by a casing-side opening in the hollow body.

4. The hollow body as claimed in claim 3, wherein the second discharge opening is formed by a casing-side opening in the hollow body, wherein the first discharge opening is configured to discharge the separated oil and the second discharge opening, which is disposed downstream of the first discharge opening as seen in the flow direction, is configured to discharge the purified gas.

5. The hollow body as claimed claim 4, wherein the hollow body is maintained rotatably mounted in a bearing device, wherein the bearing device surrounds the hollow body in a region of its at least one of the first and second discharge openings disposed on the casing-side, and the bearing device comprises a discharge channel corresponding to one of the first and second the discharge openings.

6. The hollow body as claimed in claim 3, comprising:

a flow deflection element provided within the cavity, which is arranged to deflect a flow of the purified gas towards the at least one of the first and second casing-side discharge openings.

7. The hollow body as claimed in claim 6, wherein the flow deflection element comprises a centrally disposed extension that is substantially cone-shaped and is directed with its tip in a direction opposite the flow direction and which deflects an axial flow in a direction of one of the first and second the casing-side discharge openings.

8. The hollow body as claimed in claim 6, wherein the first and second casing-side discharge openings are disposed downstream of the oil separating ring and upstream of the flow deflection element as seen in the flow direction, wherein an annular oil guiding element is disposed between the first and second discharge openings.

9. The hollow body as claimed in claim 3, wherein the swirl generator has a body extending in an axial direction of the hollow body and which comprises, on its periphery, at least one screw channel, such that a flow channel for guiding fed-in, oil-charged gas is formed by the screw channel between the body of the swirl generator and an inner wall of the hollow body.

10. The hollow body as claimed in claim 9, wherein the at least one screw channel has a non-constant pitch in its progression, wherein the pitch of the screw channel decreases in the progression of the flow path as seen in the flow direction.

11. The hollow body as claimed in claim 10, wherein the body of the swirl generator comprises a second screw channel, at least in regions of the swirl generator, such that two flow paths extending in parallel are formed at least in the regions.

12. The hollow body as claimed in claim 11, wherein the second screw channel extends approximately over half of a complete volution and extends in a same direction as the progression of the first screw channel.

13. The hollow body as claimed in claim 9, wherein at least one screw channel is mounted so as to be axially displaceable on or at a body of the swirl generator at least in regions of the swirl generator.

14. The hollow body as claimed in claim 9, wherein the at least one supply opening is disposed relative to a starting region of the at least one screw channel such that pressure loss by way of flow deviation is minimized.

15. The hollow body as claimed in claim 3, wherein the at least one supply opening is a bore disposed such that the bore extends, in regions, tangentially to an inner wall of the hollow body as seen in cross-section.

16. The hollow body as claimed in claim 3, wherein the swirl generator comprises an integrated bypass channel.

17. The hollow body as claimed in claim 16, wherein the bypass channel is formed by an axial bore in the swirl generator that can be released via a pressure-dependent bypass valve.

18. The hollow body as claimed in claim 16, wherein the hollow body comprises:

at least one further casing-side supply opening configured for introducing oil-charged gas into the cavity, wherein the further supply opening is disposed upstream of the swirl generator on a side of the swirl generator remote from the at least one discharge opening.

* * * * *